United States Patent [19]

Stewart

[11] Patent Number: 4,712,166

[45] Date of Patent: Dec. 8, 1987

[54] LIGHT FIXTURE MOUNTING

[75] Inventor: Alva N. Stewart, Newport, Ark.

[73] Assignee: Brown Jordan Company, El Monte, Calif.

[21] Appl. No.: 832,140

[22] Filed: Feb. 24, 1986

[51] Int. Cl.[4] ..... F21S 1/02

[52] U.S. Cl. ..... 362/147; 362/418; 362/430; 362/432

[58] Field of Search ..... 362/418, 421, 430, 147, 362/287, 370, 371, 382, 427, 432, 145, 152; 403/91, 119

[56] References Cited

U.S. PATENT DOCUMENTS

| | | | |
|---|---|---|---|
| 1,080,405 | 12/1913 | Anderson | 403/91 |
| 1,233,829 | 7/1917 | White | 362/432 |
| 1,927,703 | 9/1933 | Glowacki | 362/421 |
| 3,778,610 | 12/1973 | Wolf | 362/418 |
| 4,333,132 | 6/1982 | Paley | 362/427 |
| 4,492,488 | 1/1985 | Warshawsky | 403/113 |

*Primary Examiner*—William A. Cuchlinski, Jr.
*Assistant Examiner*—D. M. Cox
*Attorney, Agent, or Firm*—Christie, Parker & Hale

[57] ABSTRACT

A spherical mounting joint of a light fixture that mounts vertically on a wall has first and second couplers that attach to an angled surface of the fixture to mount the fixture vertically.

1 Claim, 4 Drawing Figures

LIGHT FIXTURE MOUNTING

FIELD OF THE INVENTION

This invention relates to lighting fixture wall mountings.

BACKGROUND OF THE INVENTION

Wall mounted light fixtures are commonly provided with mountings which include a canopy adapted to be attached to the wall and mounting bars or arms connecting the fixture to the canopy and hence to the wall. For many fixtures it is important from a decorative and support standpoint that the fixture be arranged such that its longitudinal axis be maintained parallel to the wall. Often the fixture must be arranged vertically parallel to the wall. A fixture which is not so arranged may place undue stress on the mounting bars or arms or canopy and is certainly not pleasing to the eye.

In an attempt to obtain and maintain this parallelism between the fixture and wall, the arms must be suitably sized, positioned and interconnected between the canopy and fixture.

The results obtained by sizing the arms are not always satisfactory and tend to detract from the decorative quality of the fixture. Further, these mounting means can increase the expense of manufacture of the fixture.

SUMMARY OF THE INVENTION

There is, therefore, provided according to the present invention a mounting which obtains and maintains the desired parallelism between the fixture and the wall.

Toward this end, the mounting includes a canopy having a base to be attached to a wall and an end which is opposite to the base and parallel to the wall. A spherical joint has, at a first location thereon a first coupler secured to the canopy end. The securing means may include a threaded coupler cooperatively received between the joint location and the canopy end. The joint at a second location, i.e., the degree of arc from the first location, is selected as the supplement to the angle of the surface on the fixture to which the joint is connected. That is, for example, where the fixture presents a surface which makes an angle of 45° (with respect to the horizontal) for connection by the joint then the joint second location is spaced 135° from the first location to thereby maintain the fixture parallel to the wall. The means for securing the joint to the fixture may be another of the aforesaid threaded couplers.

As can be appreciated, the joint provides a simple, inexpensive and reliable means by which the fixture may be connected to the canopy such that parallelism between the fixture and wall are maintained.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
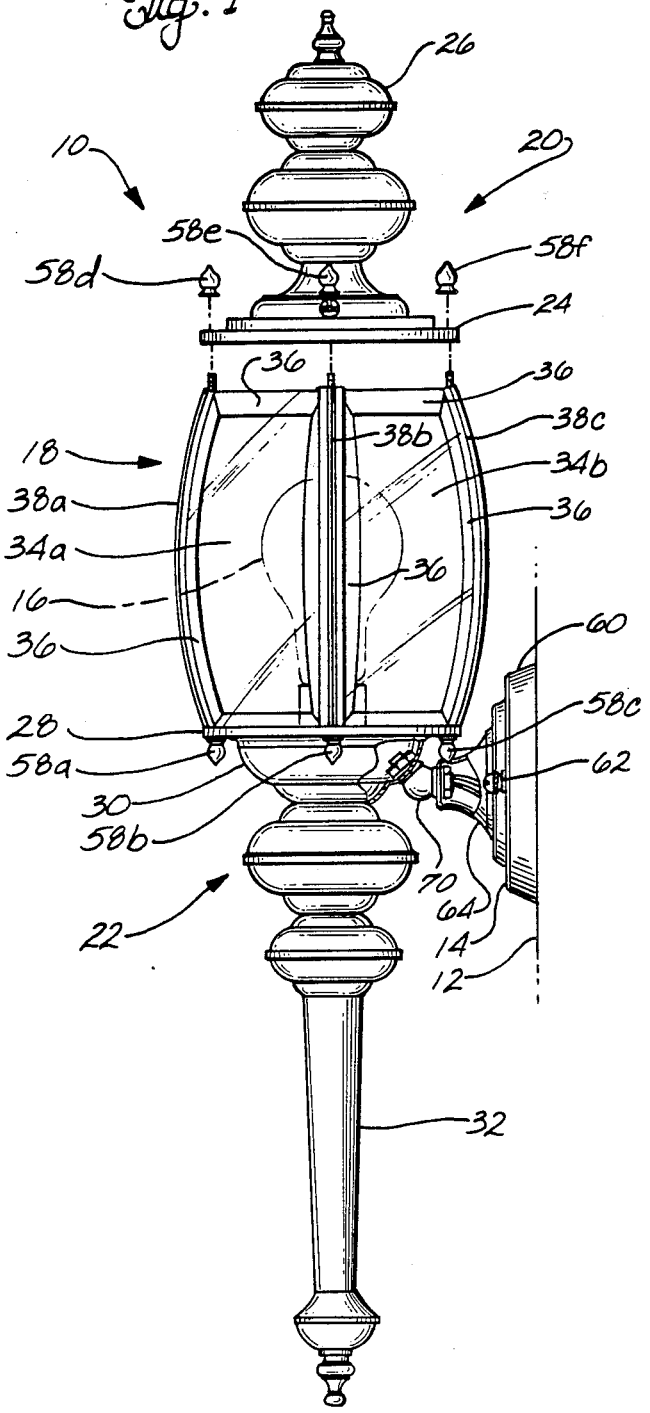
FIG. 1 is a partially exploded side view of a light fixture including the improvement according to the present invention.

Turning to FIG. 1, a fixture 10 is shown which incorporates the improvement according to the present invention. The fixture 10 is adapted to be secured to a wall 12 in an upright attitude by a canopy 14 attached to the wall 12 and by means, as hereinafter described, for interconnecting the fixture 10 to the canopy 14 such that the fixture 10 maintains an attitude parallel to the wall 14, in this instance, a vertical attitude.

The fixture 10 has a light source 16 which may be an electric light bulb or a gas flame. For the purposes of this description, the light source 16 is defined as a suitable electric light bulb. To house the light source 16, the fixture 10 further includes an enclosure 18 having a top 20 and a bottom 22. The top 20 has a circular, flat top plate 24 upon which stands an artistic decoration 26. Of course, it is to be understood that the decoration 26 as illustrated in FIG. 1 is merely exemplary in that the top 20 could include a myriad of other designs. The bottom 22 similarly includes a flat, cylindrical base plate 28 beneath which depends a somewhat spherical stamping 30 and a depending ornamentation 32. While the top and bototm 20 and 22 could be fashioned from wood or other materials, in the embodiment shown in the drawings the decoration 26, stamping 30 and ornamentation 32 are constructed from hollow brass. It is further to be understood that while description refers to top and bottom intimating that the fixture 10 has a vertical attitude, it is to be understood that depending upon its design, it could just as well have a horizontal or any other orientation parallel to the wall 12.

To transmit light from the source 16 the enclosure 18 also includes a plurality of transparent panels **34*a* and 34*b*. These panels may be fashioned from glass, acrylic or the like and may be clear or colored as desired. Further, it is to be understood that while the following description refers to the two panels 34*a* and 34*b*, it is to be understood that the enclosure could include three, four, or any other suitable number of panels. These panels 34*a* and 34*b* extend between and separate the top 20 and bottom 22**.

To contribute to or lend artistic character to the fixture 10, each of the panels **34*a* and 34*b* is curved. By curved what is meant is that the panels are non-planar in that each may be spherical, cylindrical or, as depicted in the drawings, an elliptical surface of revolution. Each panel 34*a*, 34*b* has a beveled margin 36** to enhance the artistic appearance of the fixture.

Figure 2:
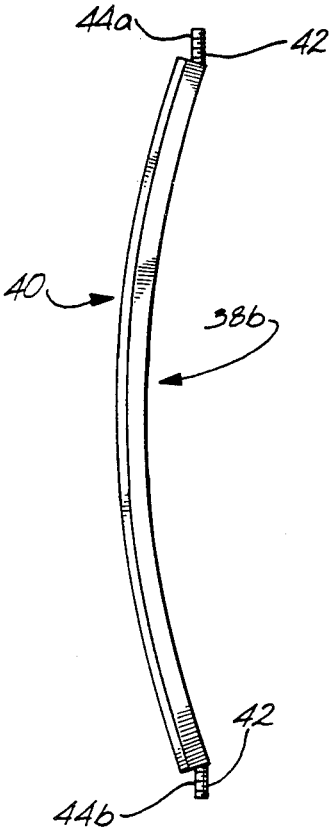
FIG. 2 is a side view of a panel post.
Figure 3:
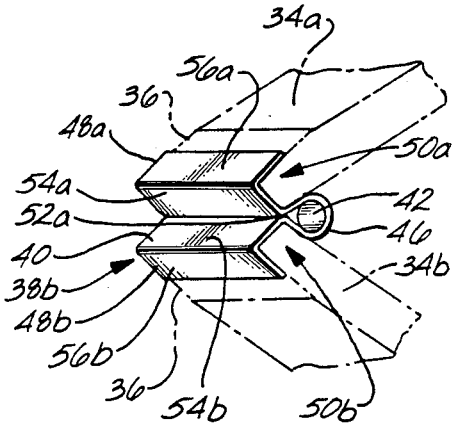
FIG. 3 is a top view of the panel post of FIG. 2 with the transparent panel shown in phantom.

To position and support the panels, mounting posts **38*a*–38*c* are provided. The number of posts, as will become apparent from the following description, will vary depending upon the number of panels. With reference to FIGS. 2 and 3, the details of post 38*b*** is shown in detail. It is to be understood that the remaining posts are identical.

Post **38*b* includes a strip 40 having a longitudinal dimension coextensive with the panels 34*a* and 34*b* and is looped about a rigid, rod-like spine 42. The spine 42 extends over the longitudinal length of the strip 40 and projects outwardly therefrom from each end to define lugs 44*a* and 44*b* which are threaded for connection to the top 20 and bottom 22. By so fashioning the strip 40 to loop about the spine 42, a loop portion 46 is defined which envelops the spine 42 as best in FIG. 3. The loop portion 46 separates and defines a pair of wings 48***a* and 48*b* which are turned to define outwardly directed, rectangular channels 50*a* and 50*b* to receive the longitudinal margins of panels 34*a* and 34*b* respectively. Wing 48*a* for this purpose is turned from the loop portion 46 defining an elbow 52*a* and a bottom wall 54*a* for the channel 50*a*. From the bottom wall 54*a*, the wing 48*a* is turned orthogonally to define a side wall 56*a*. In a similar fashion, the wing 48*b* is turned defining elbow 52*b*, bottom wall 54*b* and side wall 56*b*. Hence, the bounds of the channels are defined between the side walls, bottom walls and loop portion as is clearly illustrated in FIG. 3. Depending upon the number of panels for the fixtures, the strip 40 may be configured to define the channels such that the elbows 52*a* and 52*b* abut as illustrated. To provide rigidity, the strip 40 is preferably fashioned from metallic material such as brass or the like.

To receive the margins of the panels 34*a*, 34*b* the posts 38*a*–38*c* are curved to match the curvature of the panels side margins. As clearly illustrated in FIG. 2, when the panels are outwardly curved or bowed as illustrated in FIG. 1, the posts are cooperatively curved or bowed so as to register with and receive the side margins for the panels.

To position and support the panels 34*a* and 34*b* in the fixture, each post 38*a*–38*c* is secured to the bottom 22 and more particularly the bottom plate 28. This is accomplished by passing each lug 44*b* through appropriate bores in the bottom plate 28 and securing ornamental nuts 58*a*–58*c* thereto.

Thereafter, each of the panels 34*a*, 34*b* is inserted between the posts 38*a*–38*c* by aligning its side margins with the channels and sliding each of the panels downwardly within the channels until the panels engage the base plate 28. Since the curvature of the channels matches the curvature of the panels, the aforesaid sliding location and positioning of the panels can be accomplished. After the panels have been so positioned, the top 20 is located such that the lugs 44*a* of the posts 38*a*–38*c* register with appropriate openings in the top plate 24. The top is lowered over the posts 38*a*—38*c* and appropriate lock nuts 58*d*–58*f* are threaded over the lugs 44*a*, thereby securing the top 20 thereto.

By virtue of the posts 38, the panels are interconnected to each other and to the top 20 and bottom 22 thereby enhancing the structural integrity of the fixture 10. Further, as can be appreciated by virtue of the posts 38*a*–38*c*, the panels 38*a*, 38*b* are quickly and easily fitted into the fixture enclosure 18. Bonding or welding between the various panels is not required in that the one-piece post strip fashioned to define the channels 50*a*, 50*b* provides the necessary interconnected support.

Figure 4:
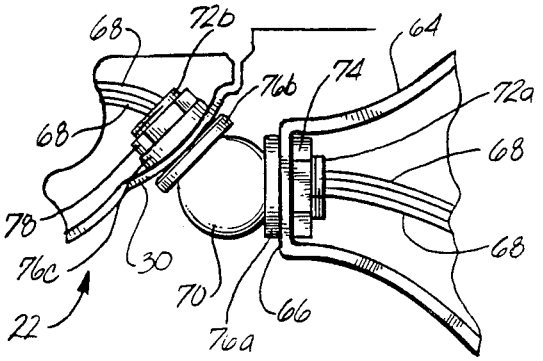
FIG. 4 is an enlarged view of the light fixture mounting according to the present invention for attaching the fixture to a wall in attitude parallel to the wall.

To mount the fixture 10 to the wall 12, the mounting means according to the present are provided. The mounting means cooperates with the canopy 14 which includes a base 60 adapted to fit flush against the wall 12 and 13 secured thereto by suitable connectors such as screws 62 (FIG. 1). As illustrated, the base 60 is frustoconical. From the base 60, the canopy 14 reduces in diameter to include a neck 64 which extends coaxially outwardly from the base 60 and reduces in diameter to a circular canopy end 66 arranged parallel to the wall 12. As best shown in FIG. 4, the canopy 14 is hollow to accommodate electrical wires 68.

To mount the fixture and more specifically the enclosure bottom 22 to the canopy 14 so as to maintain its attitude parallel to the wall 12, the connecting means includes a spherical joint 70 interconnected between the canopy 14 and stamping 30. The joint 70 has a threaded bore at one location thereon to accept a threaded first coupler 72*a* which extends from the joint 70 through canopy end 66 to have threaded thereover a nut 74. A washer 76*a* is disposed around the first coupler 72 between the joint 70 and end 66 to maintain the secure connection of the joint 70 to the canopy 14.

Viewing the fixture 10, it is seen that the stamping 30 presents for connection to the joint 70 a surface whose tangent is approximately 45° with respect to the horizontal when the fixture 10 is in a vertical attitude as shown. Of course, it is to be understood that depending upon its construction, the surface presented may have any angle.

To connect the fixture 10 to the canopy to maintain it parallel to the wall, the joint 70 further includes a second threaded bore into which is threadably secured a threaded second coupler 72*b* which extends through a bore in the stamping 30 to mount within the bottom 22 a nut 78. Washers 76*b* and 76*c* trap the stamping 30 surrounding the bore to thereby secure the fixture and enclosure 18 to the joint 70 and through the joint 70 to the canopy 14. To arrange the fixture 10 parallel to the wall, the second bore and coupler 72*b* are arranged to an arc angle A from the first coupler 72*a* which is the supplement of the angle of the stamping surface. That is, where the surface is configured to have a tangent making an angle of 45° with respect to the horizontal, angle A is 135°. This maintains the fixture 10 parallel to the wall 12. The fixture can be pivoted about the joint while, by virtue of the 45° angle between the couplers, maintaining the attitude parallel to the wall. Wires 68 pass through the first coupler 72*a*, joint 70 and second coupler 72*b* to provide electricity to the bulb defining a light source 16.

As can be appreciated, the joint 70 and structure of the canopy 14 and stamping 30 provides an inexpensive, simple and reliable structure by which the enclosure 18 can be mounted to the canopy 14 in a manner to maintain its upright, vertical attitude parallel to the wall 12 when the fixture 10 is secured thereto.

While I have shown and described certain advantages of the present invention, it is to be understood that it is subject to many modifications without departing from the spirit and scope of the claims set forth herein.

What is claimed is:

1. In a light fixture that mounts on a vertical wall and which has a top, an enclosure for a light, and a bottom, an improvement comprising:

a canopy having a base for bearing on the vertical wall, a neck extending horizontally from the base and reducing in diameter with distance from the base, and a vertical canopy end wall at the small end of the neck and having a hole through it;

the bottom of a fixture having a stamping that has a wall extending at about 45° to the horizontal, the wall having a hole through it proximate to the end wall of the canopy; and a rigid joint connecting the stamping to the canopy, the joint having a first male threaded coupler extending through the hole in the end wall of the canopy, a second male threaded coupler 135° to the first coupler and extending through the hole in the stamping wall, a spherically curved surface between the end wall of the canopy and the stamping, a first washer on the first male threaded coupler between the end wall of the canopy and the spherically curved surface, a first nut on the first male threaded coupler holding the joint and the canopy together, a second washer on the second male threaded coupler between the stamping and the spherically curved surface, and a second nut on the second male threaded coupler holding the joint and the stamping together.

* * * * *